US010779602B2

(12) United States Patent
Tuttle et al.

(10) Patent No.: US 10,779,602 B2
(45) **Date of Patent: *Sep. 22, 2020**

(54) PROTECTIVE HEADWEAR TO REDUCE RISK OF INJURY

(71) Applicants: Wayne H. Tuttle, Torrance, CA (US); Lisa C. Whitaker, Torrance, CA (US)

(72) Inventors: Wayne H. Tuttle, Torrance, CA (US); Lisa C. Whitaker, Torrance, CA (US)

( * ) Notice: Subject to any disclaimer, the term of this patent is extended or adjusted under 35 U.S.C. 154(b) by 32 days.

This patent is subject to a terminal disclaimer.

(21) Appl. No.: 15/227,593

(22) Filed: Aug. 3, 2016

(65) Prior Publication Data

US 2017/0042271 A1 Feb. 16, 2017

Related U.S. Application Data

(60) Provisional application No. 62/203,152, filed on Aug. 10, 2015.

(51) Int. Cl.

| | |
|---|---|
| ***A42B 3/12*** | (2006.01) |
| ***A42B 3/06*** | (2006.01) |
| ***A42C 2/00*** | (2006.01) |

(52) U.S. Cl.

CPC ..... *A42B 3/121* (2013.01); *A42B 3/069* (2013.01); *A42C 2/00* (2013.01)

(58) Field of Classification Search

CPC ..... A42B 3/06; A42B 3/69; A42B 3/1216; A63B 71/081; A63B 2102/14;

(Continued)

(56) References Cited

U.S. PATENT DOCUMENTS

| | | | | |
|---|---|---|---|---|
| 2,759,186 A * | 8/1956 | Dye | ..... | A42B 3/121 2/413 |
| 3,039,109 A * | 6/1962 | Simpson | ..... | A42B 3/121 2/413 |
| 3,600,714 A * | 8/1971 | Cade | ..... | A42B 3/121 2/413 |

(Continued)

OTHER PUBLICATIONS

Polycarbonate Specs. Onanon Web. Retrieved on Aug. 15, 2018. http://www.onanon.com/Polycarbonate_specs.*

(Continued)

*Primary Examiner* — Anne M Kozak

(74) *Attorney, Agent, or Firm* — Kinney & Lange, P.A.

(57) ABSTRACT

A helmet configured to protect a human head against mild traumatic brain injury upon impact includes an outer shell and a liner consisting of pairs of fluid fillable flexible fluid chambers fluidly connected to each other by fluid connections between each of the pairs of fluid fillable flexible fluid chambers being spaced on opposite sides of the helmet and configured to fill a space between the head and the outer shell when the helmet is positioned on the head. Impact resistant flexible pads are also inside the liner and are spaced around an inner circumference of the outer shell adjacent to each of the fluid fillable flexible fluid chambers. A flexible inner shell inside the liner is configured to fit closely on the head. The flexible fluid chambers are configured to compress in response to impacting of the helmet on an impact side and to force liquid through the fluid connections to inflate fluid chambers on an opposite side of the helmet thereby cushioning the head against a rebound impact on the opposite side.

20 Claims, 3 Drawing Sheets

(58) Field of Classification Search
CPC ..... A63B 2102/18; A63B 2102/22; A63B 2102/24; A63B 2243/007; A63B 2244/19; A63B 2244/20; A63B 2244/24
USPC ..... 2/412
See application file for complete search history.

(56) References Cited

U.S. PATENT DOCUMENTS 3,849,801 A 11/1974 Holt et al.
3,994,022 A * 11/1976 Villari ..... A42B 3/121 2/413
4,354,284 A * 10/1982 Gooding ..... A42B 3/00 2/413
4,375,108 A * 3/1983 Gooding ..... A42B 3/121 2/413
4,563,393 A * 1/1986 Kitagawa ..... B32B 27/08 428/412
8,739,317 B2 * 6/2014 Abernethy ..... A42B 3/121 2/410
8,844,066 B1 * 9/2014 Whitcomb ..... A42B 3/122 2/413
8,850,623 B1 * 10/2014 Mazzoccoli ..... A42B 3/121 2/411
9,468,249 B2 * 10/2016 Fraser ..... B29C 69/00
2013/0254978 A1 * 10/2013 McInnis ..... A42B 3/064 2/413
2015/0033453 A1 2/2015 Pannikottu et al.
2015/0126631 A1 * 5/2015 Bruno ..... A42B 3/125 521/54
2015/0272257 A1 * 10/2015 Pritz ..... A42B 3/127 2/414
2015/0327619 A1 11/2015 Leon

OTHER PUBLICATIONS

Barth et al., Acceleration-Deceleration Sport-Related Concussion: The Gravity of It All, dated Sep. 2001, pp. 253-256.
Laksari et al., Resonance of Human Brain Under Head Acceleration, dated May 2015, pp. 1-9.

* cited by examiner

PROTECTIVE HEADWEAR TO REDUCE RISK OF INJURY

CROSS-REFERENCE TO RELATED APPLICATION(S)

This application claims the benefit of U.S. Provisional Application No. 62/203,152 filed Aug. 10, 2015 for "Protective Headwear to Reduce Risk of Injury" by W. H. Tuttle and L. C. Whitaker, which is hereby incorporated by reference in its entirety.

BACKGROUND

This invention relates to protective head gear. In particular the invention is a helmet designed to protect against mild traumatic brain injury (MTBI).

Traumatic brain injuries can occur when the head experiences accelerations or decelerations that cause the brain to move within the skull and generate physical damage to structures within the brain. The accelerations associated with traumatic brain injuries can be linear, rotational, or complex combinations of accelerations. The brain is a soft gelatinous organ housed within the skull surrounded by liquid. During a high speed acceleration event the brain can move within the skull and impact the skull and subsequently rebound and experience additional impact with the skull on the opposite side of the brain (coup-contracoup). In lower speed acceleration events the brain may not impact the skull, but can still sustain damage as the internal structures of the brain slide past each other and damage neural interconnections.

These injuries are generally referred to as mild traumatic brain injuries (MTBI). The word mild refers to the manner of impact and not the severity of the injury. The term concussion is often used to describe mild traumatic brain injuries. Symptoms of concussion can include loss of consciousness, headaches, confusion, temporary cognitive impairment, vertigo and balance problems. More severe mild traumatic brain injuries can cause permanent impairment and increased risk of serious long term medical complications. Repeated mild traumatic brain injuries are associated with additional long term health risks including neuro degenerative brain diseases such as chronic traumatic encephalopathy which has been found in former professional athletes who have experienced multiple concussions over their careers.

Studies of the causes of concussions have demonstrated that a wide range of acceleration forces can cause concussions. For example, studies indicate that American football players regularly sustain accelerations of 20 to 180 Gs with various injury outcomes. In general the higher the G-force, the greater the injury, but some athletes have experienced concussions at impact forces below 60 G while others have been free of concussion injury at impact forces in excess of 100 G. 60 G is often considered a level below which it is unlikely that a concussive injury will occur.

SUMMARY

A helmet configured to protect a human head against mild traumatic brain injury upon impact includes an outer shell and a liner consisting of pairs of fluid fillable flexible fluid chambers fluidly connected to each other by fluid connections between each of the pairs of fluid fillable flexible fluid chambers being spaced on opposite sides of the helmet and configured to fill a space between the head and the outer shell when the helmet is positioned on the head. Impact resistant flexible pads are also inside the liner and are spaced around an inner circumference of the outer shell adjacent to each of the fluid fillable flexible fluid chambers. A flexible inner shell inside the liner is configured to fit closely on the head. The flexible fluid chambers are configured to compress in response to impacting of the helmet on an impact side and to force liquid through the fluid connections to inflate fluid chambers on an opposite side of the helmet thereby cushioning the head against a rebound impact on the opposite side.

In an embodiment, a method of forming a helmet to protect a human head against mild traumatic brain injury upon impact includes forming an outer shell larger than the head and forming pairs of fluid fillable flexible fluid chambers that fit inside the outer shell on opposite sides of the outer shell configured to fill a space between the head and the outer shell when the helmet is positioned on the head. The method further includes connecting each pair of flexible fluid chambers with a fluid connection such that each pair of fluid chambers is interconnected. The method further includes filling the pairs of interconnected flexible fluid chambers with fluid and forming impact resistant flexible pads inside and spaced around an inner circumference of the outer shell adjacent to each of the flexible fluid chambers. The method further includes forming a flexible inner shell inside the liner configured to fit closely on the head and attaching the flexible fluid chambers and flexible pads to the inner and outer shells to form the helmet such that the flexible fluid chambers are configured to compress in response to impacting of the helmet on an impact side and force liquid through the fluid connections to inflate fluid chambers on an opposite side of the helmet thereby cushioning the head against a rebound impact on the opposite side. The helmet is finished by attaching a chin strap and fastener to the helmet.

DETAILED DESCRIPTION

Figure 1:
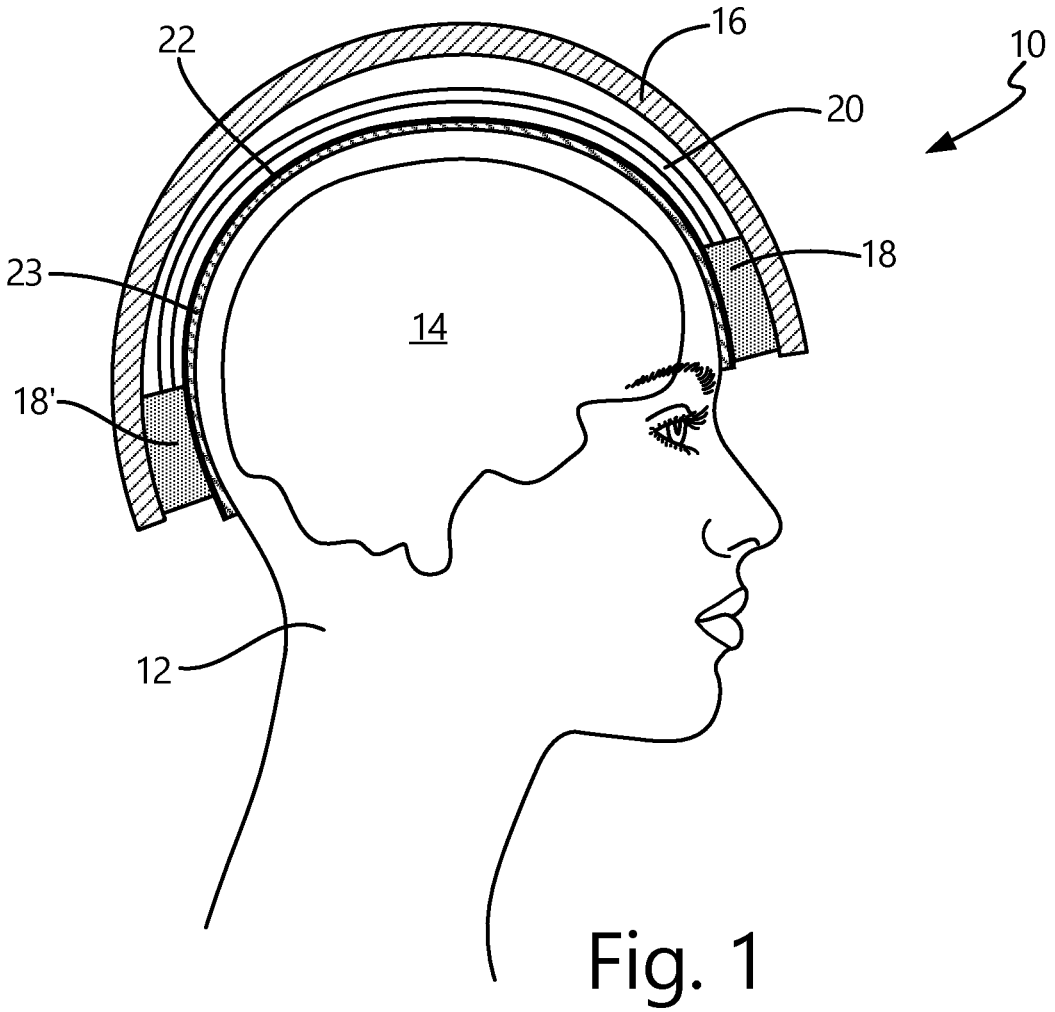
FIG. 1 is a schematic cross-section of a helmet according to an embodiment of the invention on a human head.

The present invention relates to protective headwear typically referred to as a helmet. Such a helmet fulfills the task of protecting a person's head from injury in the case of impact with other objects. Protective headwear is used in a variety of military, industrial, and sporting activities to prevent, or reduce the severity of, traumatic injury caused by foreseeable impacts associated with those activities. For example, participants in many sports such as American football, baseball, cycling, equestrian, field hockey, ice hockey, lacrosse, skiing, snowboarding, surfing, wakeboarding, and water skiing routinely wear protective helmets to reduce the risk and severity of head injuries in general and traumatic brain injury in particular. Additional activities such as automobile racing, motorcycling, and snowmobiling are sports often associated with the use of specialized protective helmets to protect the users from injuries including traumatic brain injuries.

Studies have demonstrated that the natural resonant frequency of the brain within the skull is approximately 15 Hz. If an impact generates accelerations that excite brain motions at or near its natural resonant frequency, the motions and impacts of the brain within the skull may be amplified and the damage caused can be greater than would otherwise be expected for the G-force experienced. Thus there is a need for protective helmets that will reduce the accelerations experienced by the users head and reduce the tendency of an impact event to amplify the brain's motion at or near its natural resonant frequency. Prior art has been generally good at limiting the peak acceleration forces experienced during impact. One method well known in the prior art is the use of a liner made from non-resilient compressible materials that permanently deform at selected force levels. This deformation absorbs energy and establishes the maximum acceleration level that can be experienced during the time that the material is undergoing compression. One limitation of such helmets is that by only establishing a peak value, the helmets can offer insufficient protection from lower force accelerations that trigger resonant amplifications of brain motions within the skull. An additional limitation of such designs is that after they have functioned, the liner material has lost its protective capacity and must be replaced. The materials may not appear to have been depleted and users may wrongly continue to rely on the helmet for additional impact protection.

In a typical concussive event, the head is rapidly decelerated, causing the brain to move within the skull. The brain is attached near its bottom-center and can swing about this fulcrum. As the brain moves into contact with the skull, it compresses and rebounds, contacting the opposite side of the skull. This can cause two injury sites in the brain and is referred to as a "coup-contracoup" injury. Since the brain can be considered as an underdamped mechanical system, a method of protection against coup-contracoup injury is to supply damping to the system, particularly at the resonant frequency of the brain.

There is a need for protective helmets that can reduce the impact force transferred to a user's head in terms of reducing the peak force experienced and to control the effective frequency of the energy transfer to a value that does not tend to excite brain motion amplification at its resonant frequency.

Figure 2:
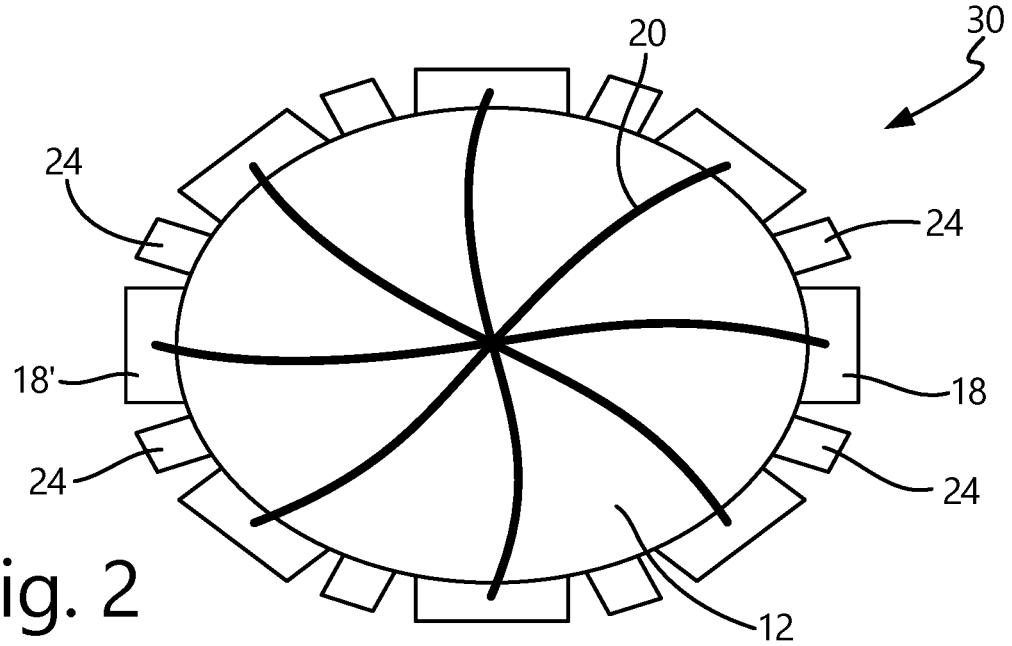
FIG. 2 is a top view of the liner of the helmet with the outer shell removed.

A non-limiting embodiment of the invention is shown in FIG. 1. FIG. 1 is a schematic cross-section of helmet system 10 on human head 12 containing brain 14. Helmet system 10 may include outer shell 16, a middle liner containing fluid filled flexible fluid chambers such as bladders 18 and interconnecting fluid passageways 20, inner liner 22, and inner shell 23. Inner shell 23 can also be referred to as a flexible inner shell. As shown in FIGS. 1-2, each of the bladders 18 have a cross-sectional area (i.e., cross-sectional diameter) that is greater than the cross-sectional area (i.e., cross-sectional diameter) of each of the interconnecting fluid passageways 20. The energy absorbing mechanism of helmet system 10 is as follows. If the user is travelling forward and experiences a frontal head-on impact with an object, head 12 will continue to move forward generating increased pressure in fluid filled bladder 18 at the forehead. The higher pressure will force fluid from bladder 18 to bladder 18' at the rear of head 12 through fluid passageway 20. Fluid passageway 20 can also be referred to as a fluid connection. The fluid viscosity and dimensions of fluid passageway 20 may be sized to establish a rate of fluid transfer during acceleration that may absorb impact energy and lengthen the time of the energy absorption process to reduce the effective frequency of the energy transfer. This action may spread the force over time and distance, to reduce the peak force experienced by brain 14. It may also increase the time over which the brain experiences the force to well above the 33 millisecond half wave period of the approximately 15 Hz resonant frequency of the brain.

An additional feature of helmet system 10 is shown in FIG. 2. FIG. 2 is a schematic top view of helmet system 10 with outer shell 16 removed. Compressible material 24 may be placed on each side of flexible fluid chambers 18 and 18' in the middle liner. The purpose of these compressible devices is to center head 12 within outer shell 16 between impact events. Compressible material 24 can also be referred to as impact resistant pads or as flexible pads. Since the flexible fluid chambers are distributed around the circumference of head 12, head 12 may be protected against the peak force of torsional accelerations as well as more complicated forms of impact. The compressible strengths of compressible material 24 (i.e., impact resistant pads) may be from about 5 G to 10 G (i.e., a gravitational force of 5-10 g) in some embodiments.

Fluid passageways 20 may be sized based on fluid viscosity to establish a rate of fluid transfer during acceleration or deceleration to absorb impact energy and to increase the time of the energy absorption process as mentioned above. In an embodiment, the fluid passageways may be flexible tubing. In another embodiment, the flexible fluid chambers and fluid interconnections may be formed from two or more sheets of a flexible polymeric material by welding patterns in the sheets defining the chambers and associated fluid interconnections.

Candidate materials for outer shell 16 may include impact resisting materials such as polycarbonate, fiberglass, or Kevlar. In an embodiment, outer shell 16 may not be a hard impact resistant shell where there is no need to spread a local impact event over a large area. A hard shell may decrease injury protection in certain cases. Examples include watersports such as wakeboarding and water skiing where the likely collision is with water at speeds in excess of 20 mph. At these speeds a hard shell of a helmet may catch its edge on the water surface transferring braking forces to a head and neck. In the case of a flexible outer shell, the mechanism of protection remains the same, but the shell becomes a form fitting compliant cover. This cover does not allow the development of significant hydrodynamic forces at the interface of a helmet and water surface. This is a preferred embodiment in sports such as wakeboarding, wakesurfing, and waterskiing, for example. Examples of compliant materials for a flexible outer shell include elastomers, elastomeric polymer, fabric, polymer impregnated fabric, elastomer impregnated fabric, laminated fabric such as Gore-Tex®, polymer fiber composite, leather, synthetic leather and others known and unknown in the art.

Figure 3:
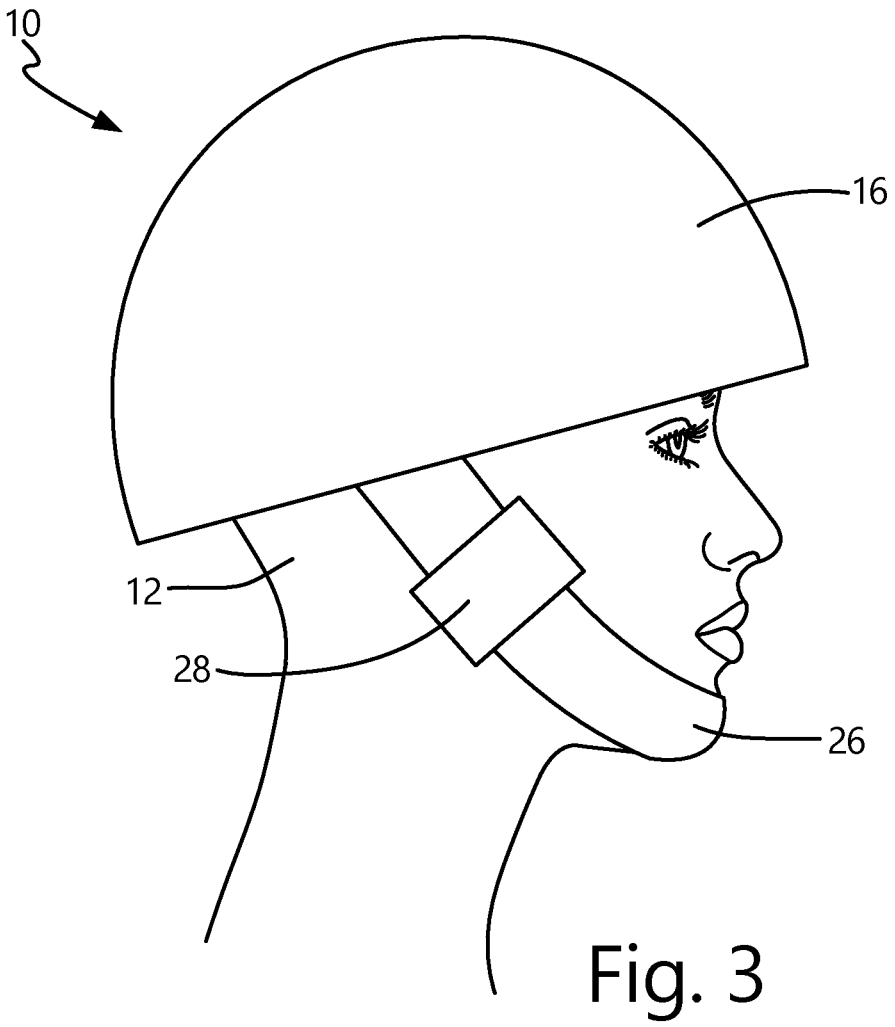
FIG. 3 is a side view of a completed helmet.

A side view of an embodiment of the invention is shown in FIG. 3. Outer shell 16 of helmet 10 is shown attached to human head 12 by chin strap 26 and fastener 28. Releasing fastener 28 enables the wearer to remove helmet 10 from head 12. Other forms of securing helmet 10 to head 12 may be used depending on the requirements of the application.

The design concept described above was examined by constructing a model head with an outer shell made from fiberglass reinforced plastic filled with various densities of resins and weights to simulate a human head. Tests were performed to measure the interaction between the model and various helmets in an impact event. A three axis accelerometer was mounted in the model head at the approximate center of the brain. Low speed impacts such as those resulting from skateboarding falls were emphasized. Two skateboarding helmets were tested.

The test setup consisted of suspending the instrumented model head with helmet over a concrete surface and dropping the helmeted head on the surface. Data acquisition was performed with a PC based oscilloscope and laptop computer. Maximum G-force and total impulse time were measured. Drop distances of 12 and 24 inches were used with and without the hydraulic damping mechanism described above installed in the helmet. Two skateboard helmets were tested. Five tests were carried out on each helmet and the data were averaged. A goal of less than 150 G was set for the tests. Maximum G-forces and impulse times for the bare helmets for a 12 inch drop were 82 G and 76 G and impulse times were 11 and 9.2 msec. Maximum G-force and impulse time for a skateboard helmet containing the hydraulic damping mechanism of the invention for the 12 inch drop were 25 G and 19.4 msec, indicating a considerable increase in protection. As expected, peak G-forces experienced after a 24 inch drop were much higher. G-forces for the two skateboard helmets without hydraulic damping were 208 G and 189 G and impulse times were 6.2 and 4.5 msec. These G-forces were above the 150 G goal mentioned above and one of the helmets cracked during the test. G-forces and impulse times measured for the skateboard helmet with the hydraulic damping mechanism installed for the 24 inch drop were 37 G and 19 msec. The G-force was decreased to about 20% and the impulse time was increased by about 3 times with the hydraulic damping feature described above.

Figure 4:
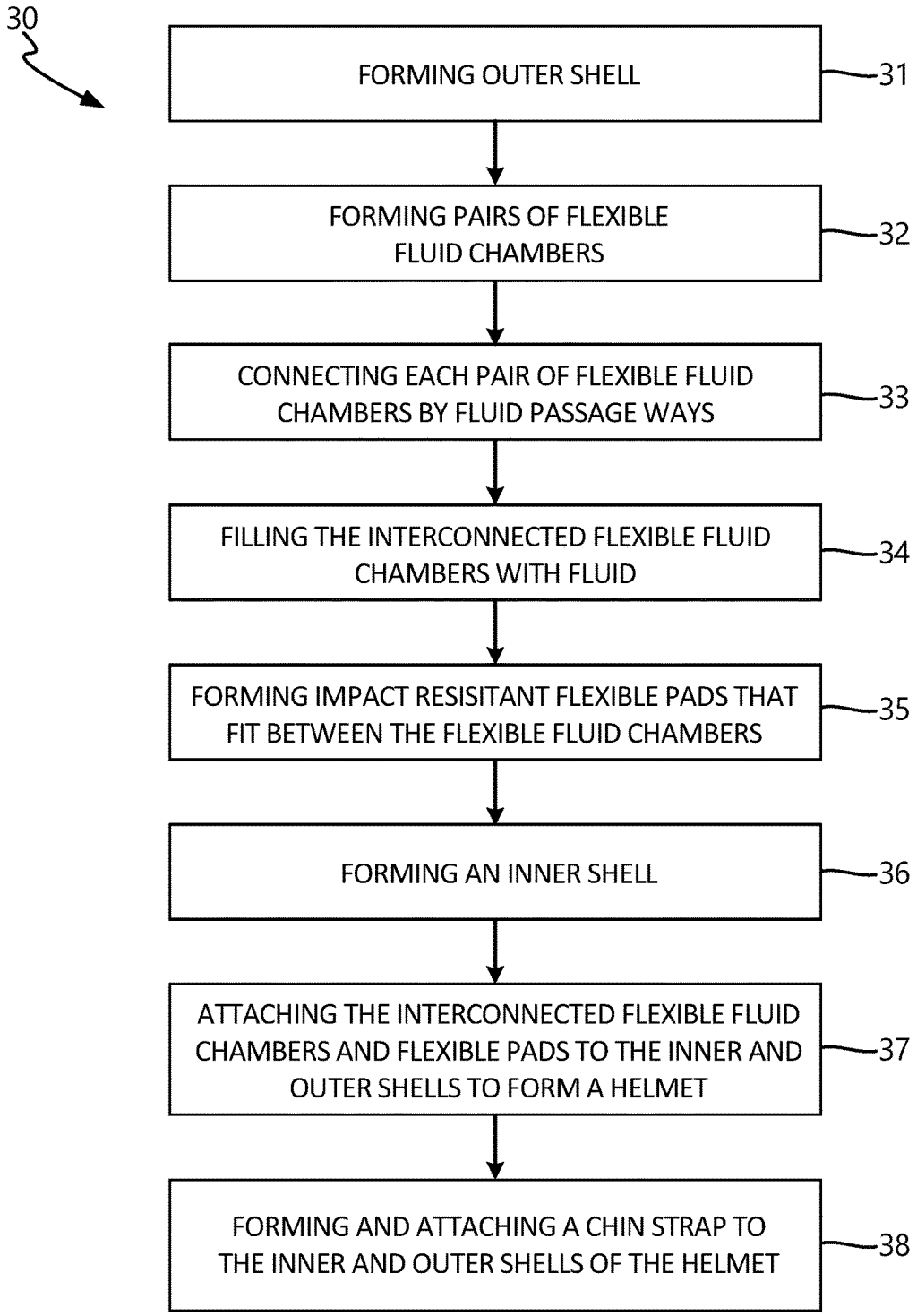
FIG. 4 is a method of forming a helmet according to an embodiment of the invention.

A method of forming helmet 10 according to an embodiment of the invention is shown in FIG. 4. Method 30 comprises forming outer shell 16 (step 31). Outer shell 16 may be a hard impact resistant shell that is larger than head 12, or may be a flexible shell that is larger than head 12. In an embodiment, a preferred hard impact resistant shell material may be a polycarbonate polymer with a Rockwell M hardness greater than 62. In another embodiment, a preferred flexible shell material may be a synthetic leather. The method may also include forming pairs of flexible fluid chambers for installation in the space between the outer and inner shells of the helmet (step 32). The flexible fluid chambers are designed to contain liquids of different viscosities. Each pair of flexible fluid chambers are then fluidly connected by tubing of various diameters depending on the anticipated functions of the helmet (step 33). Examples of flexible tubing suitable for the invention include vinyl, PVC, silicone, and others known and not known in the art. In an embodiment, the chambers and interconnected tubes may be made from the same sheets of material with the size and shape of the chambers and fluid passageways established by pattern welding sheets of the material together. The interconnected bladders may then be filled with fluid (step 34). Suitable fluids for the invention include water, glycerin, mineral oils, ethylene glycol and others known and not known in the art. Flexible pads may then be formed for installation next to the flexible fluid chambers to fix the location of the flexible fluid chambers in the space between the outer and inner shells of the helmet (step 35). In an embodiment, the pads may be designed to deform under impacts exceeding about 5 G to 10 G. Candidate materials include open cell and closed cell foam made from synthetic materials including silicone and polyurethane. In the next step an inner shell may be formed (step 36). The inner shell may be a flexible material that conforms closely to the head of the wearer. Materials suitable for an inner shell may include the above materials noted for the flexible outer shell.

Assembling the helmet may include attaching the interconnected flexible fluid chambers and flexible pads to the outer and inner shells in the space between the shells to form a helmet (step 37). In the final step, a chin strap and connector may be attached to the outer and inner shells to form a finished helmet (step 38).

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A helmet configured to protect a human head against mild traumatic brain injury upon impact comprising:

an outer shell;

a liner inside the outer shell, the liner comprising:

a first pair of interconnected fluid fillable flexible fluid chambers comprising a first fluid fillable flexible fluid chamber, a second fluid fillable flexible fluid chamber on an opposite side of the liner from the first fluid fillable flexible fluid chamber, and a first fluid connection fluidically interconnecting the first fluid fillable flexible fluid chamber and the second fluid fillable flexible fluid chamber, wherein a cross-sectional area of the first fluid connection is less than a cross-sectional area of either the first or second fluid fillable flexible fluid chamber; and a second pair of interconnected fluid fillable flexible fluid chambers comprising a third fluid fillable flexible fluid chamber, a fourth fluid fillable flexible fluid chamber on an opposite side of the liner from the third fluid fillable flexible fluid chamber, and a second fluid connection fluidically interconnecting the third fluid fillable flexible fluid chamber and the fourth fluid fillable flexible fluid chamber, wherein a cross-sectional area of the second fluid connection is less than a cross-sectional area of either the third or fourth fluid fillable flexible fluid chamber;

impact resistant pads inside and spaced around an inner circumference of the outer shell adjacent to each of the fluid fillable flexible fluid chambers; and a flexible inner shell inside the liner, the flexible inner shell configured to fit on the human head;

wherein the first and third fluid fillable flexible fluid chambers are configured to compress in response to impacting of the helmet on an impact side, thereby cushioning the human head against a rebound impact on the opposite side by causing one or more of the following to occur:

forcing fluid from the first fluid fillable flexible fluid chamber through the first fluid connection into the second fluid fillable flexible fluid chamber; or forcing fluid from the third fluid fillable flexible fluid chamber through the second fluid connection into the fourth fluid fillable flexible fluid chamber.

2. The helmet of claim 1, wherein the liner further comprises:

a third pair of interconnected fluid fillable flexible fluid chambers comprising a fifth fluid fillable flexible fluid chamber, a sixth fluid fillable flexible fluid chamber on an opposite side of the liner from the fifth fluid fillable flexible fluid chamber, and a third fluid connection fluidically interconnecting the fifth fluid fillable flexible fluid chamber and the sixth fluid fillable flexible fluid chamber, wherein a cross-sectional area of the third fluid connection is less than a cross-sectional area of either the fifth or sixth fluid fillable flexible fluid chamber; and a fourth pair of interconnected fluid fillable flexible fluid chambers comprising a seventh fluid fillable flexible fluid chamber, an eighth fluid fillable flexible fluid chamber on an opposite side of the liner from the seventh fluid fillable flexible fluid chamber, and a fourth fluid connection fluidically interconnecting the seventh fluid fillable flexible fluid chamber and the eighth fluid fillable flexible fluid chamber, wherein a cross-sectional area of the fourth fluid connection is less than a cross-sectional area of either the seventh or eighth fluid fillable flexible fluid chamber;

wherein the fifth and seventh fluid fillable flexible fluid chambers are configured to compress in response to impacting of the helmet on an impact side, thereby cushioning the human head against a rebound impact on the opposite side by causing one or more of the following to occur:

forcing fluid from the fifth fluid fillable flexible fluid chamber through the third fluid connection into the sixth fluid fillable flexible fluid chamber; or forcing fluid from the seventh fluid fillable flexible fluid chamber through the fourth fluid connection into the eighth fluid fillable flexible fluid chamber.

3. The helmet of claim 2, wherein:

the impact resistant pads are eight impact resistant pads; and wherein the eight fluid fillable flexible fluid chambers and the eight impact resistant pads are arranged in an alternating order around the inner circumference of the outer shell.

4. The helmet of claim 1, wherein the outer shell is a hard material with a hardness greater than Rockwell M 62.

5. The helmet of claim 4, wherein the outer shell is composed of a material that is selected from the group consisting of polycarbonate, fiberglass and Kevlar.

6. The helmet of claim 1, wherein the outer shell is a flexible material.

7. The helmet of claim 6 where the outer shell is composed of a material that is selected from the group consisting of elastomer, elastomeric polymer, polymer impregnated fabric, elastomer impregnated fabric, laminated fabric, polymer fiber composite, leather, and synthetic leather.

8. The helmet of claim 1, wherein each of the first, second, third, and fourth fluid fillable flexible fluid chambers are filled with water, mineral oil, or mixtures of water and non-toxic antifreeze liquids.

9. The helmet of claim 1, wherein the impact resistant pads are configured to deform upon an impact exceeding a gravitational force of 5 g.

10. The helmet of claim 1, wherein the inner shell is composed of a material that is selected from the group consisting of elastomer, elastomeric polymer, polymer impregnated fabric, elastomer impregnated fabric, laminated fabric, polymer fiber composite, leather, and synthetic leather.

11. A method of forming a helmet to protect a human head against mild traumatic brain injury upon impact, the method comprising:

forming an outer shell larger than the human head;

forming a liner inside the outer shell, the liner comprising:

a first pair of interconnected fluid fillable flexible fluid chambers comprising a first fluid fillable flexible fluid chamber, a second fluid fillable flexible fluid chamber on an opposite side of the liner from the first fluid fillable flexible fluid chamber, and a first fluid connection fluidically interconnecting the first fluid fillable flexible fluid chamber and the second fluid fillable flexible fluid chamber, wherein a cross-sectional area of the first fluid connection is less than a cross-sectional area of either the first or second fluid fillable flexible fluid chamber; and a second pair of interconnected fluid fillable flexible fluid chambers comprising a third fluid fillable flexible fluid chamber, a fourth fluid fillable flexible fluid chamber on an opposite side of the liner from the third fluid fillable flexible fluid chamber, and a second fluid connection fluidically interconnecting the third fluid fillable flexible fluid chamber and the fourth fluid fillable flexible fluid chamber, wherein a cross-sectional area of the second fluid connection is less than a cross-sectional area of either the third or fourth fluid fillable flexible fluid chamber;

filling the first and second pairs of interconnected fluid fillable flexible fluid chambers with a fluid;

forming impact resistant pads inside and spaced around an inner circumference of the outer shell adjacent to each of the fluid fillable flexible fluid chambers;

forming a flexible inner shell inside the liner, the flexible inner shell configured to fit on the human head;

attaching the liner inside the outer shell, wherein the first and third fluid fillable flexible fluid chambers are configured to compress in response to impacting of the helmet on an impact side, thereby cushioning the human head against a rebound impact on the opposite side by causing one or more of the following to occur:

force fluid from the first fluid fillable flexible fluid chamber through the first fluid connection into the second fluid fillable flexible fluid chamber; or force fluid from the third fluid fillable flexible fluid chamber through the second fluid connection into the fourth fluid fillable flexible fluid chamber;

attaching the impact resistant pads to the inner and outer shells, wherein the impact resistant pads are inside and spaced around an inner circumference of the outer shell adjacent to each of the fluid fillable flexible fluid chambers; and attaching a chin strap and fastener to the helmet.

12. The method of claim 11, wherein the liner further comprises:

a third pair of interconnected fluid fillable flexible fluid chambers comprising a fifth fluid fillable flexible fluid chamber, a sixth fluid fillable flexible fluid chamber on an opposite side of the liner from the fifth fluid fillable flexible fluid chamber, and a third fluid connection fluidic ally interconnecting the fifth fluid fillable flexible fluid chamber and the sixth fluid fillable flexible fluid chamber, wherein a cross-sectional area of the third fluid connection is less than a cross-sectional area of either the fifth or sixth fluid fillable flexible fluid chamber; and a fourth pair of interconnected fluid fillable flexible fluid chambers comprising a seventh fluid fillable flexible fluid chamber, an eighth fluid fillable flexible fluid chamber on an opposite side of the liner from the seventh fluid fillable flexible fluid chamber, and a fourth fluid connection fluidically interconnecting the seventh fluid fillable flexible fluid chamber and the eighth fluid fillable flexible fluid chamber, wherein a cross-sectional area of the fourth fluid connection is less than a cross-sectional area of either the seventh or eighth fluid fillable flexible fluid chamber;

wherein the fifth and seventh fluid fillable flexible fluid chambers are configured to compress in response to impacting of the helmet on an impact side, thereby cushioning the head against a rebound impact on the opposite side by causing one or more of the following to occur:

forcing fluid from the fifth fluid fillable flexible fluid chamber through the third fluid connection into the sixth fluid fillable flexible fluid chamber; or forcing fluid from the seventh fluid fillable flexible fluid chamber through the fourth fluid connection into the eighth fluid fillable flexible fluid chamber.

13. The method of claim 12, wherein:

the impact resistant pads are eight impact resistant pads; and the eight fluid fillable flexible fluid chambers and the eight impact resistant pads are arranged in an alternating order around the inner circumference of the outer shell.

14. The method of claim 11, wherein the outer shell material is a hard material with a hardness greater than Rockwell M 62.

15. The method of claim 14, wherein the outer shell is composed of a material that is selected from the group consisting of polycarbonate, fiberglass and Kevlar.

16. The method of claim 11, wherein the outer shell is a flexible material.

17. The method of claim 16, wherein the outer shell is composed of a material that is selected from the group consisting of elastomer, elastomeric polymer, polymer impregnated fabric, elastomer impregnated fabric, laminated fabric, polymer fiber composite, leather, and synthetic leather.

18. The method of claim 11, wherein the impact resistant pads are configured to deform under an impact exceeding a gravitational force of 5 g.

19. The method of claim 11, wherein each of the first, second, third, and fourth fluid fillable flexible fluid chambers are filled with water, mineral oil, or mixtures of water and non-toxic antifreeze liquids.

20. The method of claim 11, wherein:

the first pair of interconnected fluid fillable flexible fluid chambers are produced from two or more sheets of polymeric material by welding the two or more sheets along a pattern defining the first and second fluid fillable flexible fluid chambers and the first fluid connection; and the second pair of interconnected fluid fillable flexible fluid chambers are produced from two or more sheets of polymeric material by welding the two or more sheets along a pattern defining the third and fourth fluid fillable flexible fluid chambers and the second fluid connection.

* * * * *